United States Patent [19]

Campbell

[11] Patent Number: 4,774,224

[45] Date of Patent: Sep. 27, 1988

[54] RESIN-COATED PAPER SUPPORT FOR RECEIVING ELEMENT USED IN THERMAL DYE TRANSFER

[75] Inventor: Robert B. Campbell, Pittsford, N.Y.

[73] Assignee: Eastman Kodak Company, Rochester, N.Y.

[21] Appl. No.: 123,436

[22] Filed: Nov. 20, 1987

[51] Int. Cl.[4] ..... B41M 5/035; B41M 5/26

[52] U.S. Cl. ..... 503/227; 8/471; 427/146; 427/256; 428/195; 428/409; 428/412; 428/513; 428/518; 428/537.5; 428/913; 428/914; 430/945

[58] Field of Search ..... 8/470, 471; 427/146, 427/256; 428/195, 409, 412, 513, 518, 537.5, 913, 914; 430/200, 201, 945

[56] References Cited

U.S. PATENT DOCUMENTS 4,720,480 1/1988 Ito et al. ..... 503/227

FOREIGN PATENT DOCUMENTS 236794 11/1985 Japan ..... 503/227

*Primary Examiner*—Bruce H. Hess
*Attorney, Agent, or Firm*—Harold E. Cole

[57] ABSTRACT

A dye-receiving element for thermal dye transfer comprising a resin-coated paper support having thereon a polymeric dye image-receiving layer, the resin coating having a surface roughness measurement of 7.5 Ra microinches-AA or less.

20 Claims, No Drawings

RESIN-COATED PAPER SUPPORT FOR RECEIVING ELEMENT USED IN THERMAL DYE TRANSFER

This invention relates to dye-receiving elements used in thermal dye transfer, and more particularly to the use of a resin-coated paper support having a certain surface roughness.

In recent years, thermal transfer systems have been developed to obtain prints from pictures which have been generated electronically from a color video camera. According to one way of obtaining such prints, an electronic picture is first subjected to color separation by color filters. The respective color-separated images are then coverted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

In JP No. 60/236,794, polyethylene-coated paper supports are disclosed for use in thermal dye transfer systems. A problem exists with using those supports, however, in that the appearance of the thermally-transferred print is not always uniform.

It would be desirable to provide a resin-coated paper support for use as a dye-receiving element for thermal dye transfer systems which would have a more uniform surface appearance.

These and other subjects are achieved in accordance with this invention which comprises a dye-receiving element for thermal dye transfer comprising a resin-coated paper support having thereon a polymeric dye image-receiving layer, the resin coating having a surface roughness measurement of 7.5 Ra microinches-AA or less.

Surface roughness measurements are made by the ANSI/ASME B46.1-1985 test on page 30, Sect. C3.1.1, described in the "1985 Catalog of American National Standards", published by the American Society of Mechanical Engineers (jointly with the American National Standards Institute); United Engineering Center, 345 E. 47th Street, New York, N.Y. 10017. The definition for Ra (Roughness average) and microinches-AA (Arithmetic Average) is also described in the above article.

It was found that the appearance of the print of a thermally-transferred image varied depending upon the surface roughness of the resin-coated paper stock. A paper stock having a very matte resin-coated surface with a high Ra surface roughness produces a dye-transfer image that appears glossy in maximum density areas. This is caused by the greater heating in those areas which transforms the inherent matte receiver surface to a glossy surface. In the minimum density areas, however, where there is less heating, the inherent matte receiver surface remains matte. The difference in gloss is very noticeable and objectionable.

In accordance with this invention, a relatively smoother resin-coated support is obtained which provides a dye-transfer image which retains its glossy surface regardless of whether one looks at the minimum or maximum density areas. The inherent roughness of the paper stock and the density of the paper fibers were not found to be critical. Thus, the surface appearance of images obtained in accordance with the invention is less variable than that of the prior art.

In a preferred embodiment of the invention, a subbing layer is present between the resin-coated surface and the dye image-receiving layer. For example, a subbing layer may be used which is a vinylidene chloride copolymer, such as one comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride. Further examples of these subbing layers are found in Ser. No. 097,228 of Vanier and Lum, filed Sept. 15, 1987, entitled "Subbing Layer for Dye Image-Receiving Layer Used in Thermal Dye Transfer".

The resin coating for the paper support may be any polymeric material which has been used in the art to provide a smooth coating on paper, and which has a sufficiently high heat deflection so as to not soften appreciably by a thermal print head or a heated finishing roller. In a preferred embodiment of the invention, polyolefins are used such as polyethylene, polypropylene, etc. In another preferred embodiment, white pigments such as titanium dioxide, zinc oxide, etc., may be added to the resin coating to provide reflectivity.

The polymeric dye image-receiving layer of the dye-receiver of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

In a preferred embodiment of the invention, the dye image-receiving layer is a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl) propane, bis(4-oxyphenyl)methane, 1,1-bis(4-oxyphenyl)ethane, 1,1-bis-(oxyphenyl)butane, 1,1-bis(oxyphenyl)cyclohexane, 2,2-bis(oxyphenyl)butane, etc.

In another preferred embodiment of the invention, the polycarbonate dye image-receiving layer is a bisphenol-A polycarbonate having a number average molecular weight of at least about 25,000. In still another preferred embodiment of the invention, the bisphenol-A polycarbonate comprises recurring units having the formula

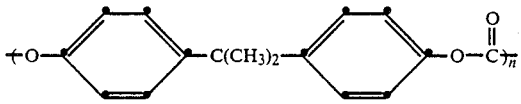

wherein n is from about 100 to about 500.

Examples of such polycarbonates include General Electric Lexan® Polycarbonate Resin #ML-4735 (Number average molecular weight app. 36,000), and Bayer AG Makrolon #5705® (Number average molecular weight app. 58,000). The later material has a $T_g$ of 150° C.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

(magenta)

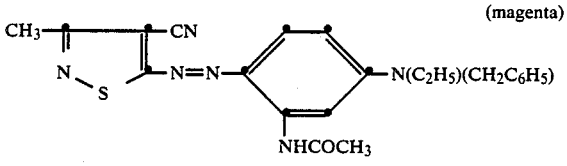

(yellow)

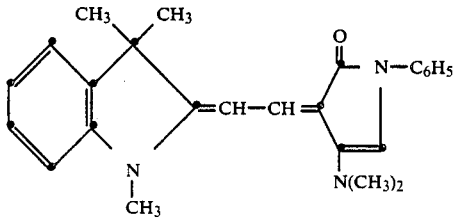

-continued (cyan)

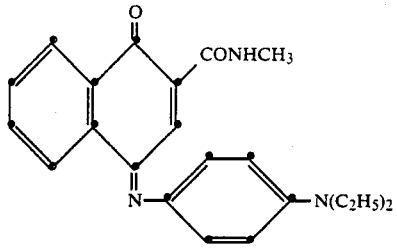

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye barrier layer comprising a hydrophilic polymer may also be employed in the dye-donor element between its support and the dye layer which provides improved dye transfer densities. Such dye-barrier layer materials include those described and claimed in U.S. Pat. No. 4,700,208 of Vanier et al, issued Oct. 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE 1

(A) A dye-receiver in accordance with the invention was prepared by obtaining a commercially produced paper stock 6.5 mil (165 μm) thick 40 lb/1000 ft$^2$ (195 g/m$^2$) mixture of hard woodkraft and soft wood-sulfite bleached pulp. The paper stock was then extrusion overcoated with an approximately 1:4 ratio of medium density:high density polyethylene (2.5 lb/1000 ft$^2$) (12 g/m$^2$) with approximately 6 wt. percent anatase titanium dioxide and 1.5 wt. percent zinc oxide (layer thickness 12 μm). The extrusion overcoating operation used separate chill rollers each of different smoothness to produce coated paper stock receivers of different smoothness as described in the table. The support was then coated with the following layers:

(a) Subbing layers of poly(acrylonitrile)-covinylidene chloride-co-acrylic acid (14:79:7 wt. ratio) (0.54 g/m$^2$) coated from a butanone and cyclopentanone solvent mixture; and (c) Dye-receiving layer of Makrolon 5705 ® polycarbonate (Bayer AG) (2.9 g/m$^2$), 1,4-didecoxy-2,5-dimethoxybenzene (0.38 g/m$^2$), and FC-431 ® surfactant (3M Co.) (0.016 g/m$^2$) coated from methylene chloride.

The back side of the receiver was coated with a polyethylene layer and an overcoat layer.

A dye-donor element was prepared by coating on a 6 μm poly(ethylene terephthalate) support dye layers containing the dyes as identified above (0.77 mmoles/m$^2$), and FC-431 ® (3M Corp.) surfactant 2.2 mg/m$^2$) in a cellulose acetate proportionate (40% acetyl and 17% propionyl) binder (at 1.8 times that of the dye) coated from a toluene, methanol and cyclopentanone solvent mixture. On the back side of the element was coated a slipping layer of the type disclosed in copending U.S. patent application Ser. No. 076,433 of Henzel et al, filed July 21, 1987.

The dye side of the dye-donor element strip one inch (25 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head L-133 (No. C6-0242) and was pressed with a spring at a force of 8 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at increments from 0 up to 8.3 msec to generate a graduated density test pattern. The voltage supplied to the print head was approximately 21 v representing approximately 1.7 watts/dot (12 mjoules/dot).

The dye-receiving element was separated from the dye-donor element. The receiving elements were then examined and measured for surface gloss. The following results were obtained:

TABLE

| Paper Stock | Ra (microinches-AA) | Differential Gloss Upon Printing |
|---|---|---|
| Smooth Glossy | 1.0 | No |
| Rough Glossy | 4.5 | No |
| V. Rough Glossy | 7.5 | No |
| Matte | 50 | Yes |

The above results indicate that the receiving elements having a surface roughness of about 7.5 Ra microinches-AA or less do not have a differential gloss upon printing, and thus are superior prints.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a resin-coated paper support having thereon a polymeric dye image-receiving layer, said resin coating having a surface roughness measurement of 7.5 Ra microinches-AA or less.

2. The element of claim 1 wherein a subbing layer is present between said resin-coated surface and said dye image-receiving layer.

3. The element of claim 2 wherein said subbing layer comprises a vinylidene chloride copolymer.

4. The element of claim 1 wherein said resin is a polyolefin.

5. The element of claim 4 wherein said polyolefin is polyethylene.

6. The element of claim 5 wherein said polyethylene layer also contains titanium dioxide.

7. The element of claim 1 wherein said dye image-receiving layer is a bisphenol-A polycarbonate having a number average molecular weight of at least about 25,000.

8. The element of claim 7 wherein said bisphenol-A polycarbonate comprises recurring units having the formula

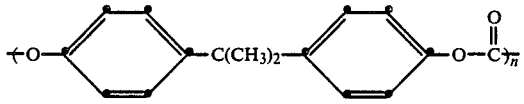

wherein n is from about 100 to about 500.

9. In a process of forming a dye transfer image comprising imagewise-heating a dye-donor element comprising a support having thereon a dye layer and transferring a dye image to a dye-receiving element to form said dye transfer image, said dye-receiving element comprising a support having thereon a polymeric dye image-receiving layer, the improvement wherein said support of said dye-receiving element is a resin-coated paper support having a surface roughness measurement of 7.5 Ra microinches-AA or less.

10. The process of claim 9 wherein a subbing layer is present between said resin-coated surface and said dye image-receiving layer.

11. The process of claim 9 wherein said resin is a polyolefin.

12. The process of claim 11 wherein said polyeolefin is polyethylene.

13. The process of claim 12 wherein said polyethylene layer also contains titanium dioxide.

14. The process of claim 9 wherein said dye image-receiving layer is a bisphenol-A polycarbonate having a number average molecular weight of at least about 25,000.

15. In a thermal dye transfer assemblage comprising:

(a) a dye-donor element comprising a support having thereon a dye layer, and (b) a dye-receiving element comprising a support having thereon a polymeric dye image-receiving layer, said dye-receiving element being in a superposed relationship with said dye-donor element so that said dye layer is in contact with said dye image-receiving layer, the improvement wherein said support of said dye-receiving element is a resin-coated paper support having a surface roughness measurement of 7.5 Ra microinches-AA or less.

16. The assemblage of claim 15 wherein a subbing layer is present between said resin-coated surface and said dye image receiving layer.

17. The assemblage of claim 15 wherein said resin is a polyolefin.

18. The assemblage of claim 17 wherein said polyolefin is polyethylene.

19. The assemblage of claim 18 wherein said polyethylene layer also contains titanium dioxide.

20. The assemblage of claim 15 wherein said dye image-receiving layer is a bisphenol-A polycarbonate having a number average molecular weight of at least about 25,000.

* * * * *